US006334437B1

(12) United States Patent
Jessberger

(10) Patent No.: US 6,334,437 B1
(45) Date of Patent: Jan. 1, 2002

(54) SYSTEM FOR RECIRCULATING EXHAUST GAS IN AN INTERNAL COMBUSTION ENGINE

(75) Inventor: Thomas Jessberger, Rutesheim (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/508,763

(22) PCT Filed: Sep. 12, 1998

(86) PCT No.: PCT/EP98/05820

§ 371 Date: Apr. 25, 2000

§ 102(e) Date: Apr. 25, 2000

(87) PCT Pub. No.: WO99/14477

PCT Pub. Date: Mar. 25, 1999

(30) Foreign Application Priority Data

Sep. 16, 1997 (DE) ..... 197 40 584

(51) Int. Cl.[7] ..... F02M 25/07
(52) U.S. Cl. ..... 123/568.12
(58) Field of Search ..... 123/568.11, 568.12; 60/605.2

(56) References Cited

U.S. PATENT DOCUMENTS

| | | | | | |
|---|---|---|---|---|---|
| 3,937,196 | A | * | 2/1976 | Cook et al. | 123/568.12 |
| 4,072,133 | A | * | 2/1978 | McWhirter | 123/184.35 |
| 4,119,071 | A | * | 10/1978 | Hattori | 123/430 |
| 4,134,377 | A | * | 1/1979 | Bamsey et al. | 123/568.12 |
| 4,938,176 | A | * | 7/1990 | Tanaka et al. | 123/568.17 |
| 5,490,488 | A | * | 2/1996 | Aversa et al. | 123/568.12 |
| 5,666,930 | A | * | 9/1997 | Elder | 123/568.12 |
| 5,931,131 | A | * | 8/1999 | Hackett | 123/568.12 |
| 5,970,960 | A | * | 10/1999 | Azuma | 123/568.12 |

FOREIGN PATENT DOCUMENTS

DE 19740998 A1 * 3/1998

* cited by examiner

*Primary Examiner*—Willis R. Wolfe
(74) *Attorney, Agent, or Firm*—Crowell & Moring LLP

(57) ABSTRACT

A system for recirculating exhaust gas in an internal combustion engine in which a connecting line for the recirculated exhaust gas is connected to an air intake tube with cooling elements arranged in between. The cooling element may be, for example, a cooling channel for liquid coolant integrated into the flange connecting the connecting line to the air intake tube, or it may be another heat conductive element.

6 Claims, 5 Drawing Sheets

SYSTEM FOR RECIRCULATING EXHAUST GAS IN AN INTERNAL COMBUSTION ENGINE

STATE OF THE ART

The invention relates to a system for recycling exhaust gas in an internal combustion engine according to the preamble of the principal claim.

In a system of this kind disclosed in DE 30 34 971 C2 exhaust gases of the internal combustion engine are returned to the intake duct for the internal combustion engine. The connecting duct is here embedded in a heat exchanger for cooling the recycled exhaust gas through a broad range.

Taken in itself, it is also known that the recycled exhaust duct is fastened by a flange with two screws to the air intake tube made of plastic. In order to insulate the exhaust gas duct thermally from the air intake tube, mixture air is fed in the area of the flange by means of a diffuser tube. With this arrangement the exhaust gas temperature can be lowered in the area of the flange from about 450° C. to about 125° C. at a recycling rate of about 20%.

Thermal peaks occur in such systems, especially in the areas of the gaskets, made of plastic as a rule, at the connection of the duct carrying the returned exhaust gas and in areas lying opposite the air entry opening. It is often difficult, due to the relatively small cross sections and relative long paths, to carry away sufficient heat. In many applications, in connection with direct injection motors, also on account of the exhaust gas return rate to be expected (up to 50%), there is frequently a call for cylinder-selective introduction of the exhaust gas, which leads to additional thermal problems.

STATEMENT OF THE PROBLEM

The invention is addressed to the problem of improving a system of the kind referred to above such that an optimum lowering of the temperature will be possible.

ADVANTAGES OF THE INVENTION

The system of the invention is advantageously suitable, setting out from the generic kind, for solving the stated problem by the distinctive features of the principal claim. Owing to the fact that a cooling element in the form of a cooling channel for a liquid coolant is placed in a connecting duct for the recycled gas, which is integrated into the flange-like attachment of the duct connecting to the intake tube, the thermal stress on the plastic intake tube can be reduced at high recycling rates by simple means. Also the temperature of the aspirated air in the air intake tube can thereby be positively influenced.

In general, with the system according to the invention the thermal stress of the internal combustion engine, the exhaust temperature, the NOx emission and the fuel consumption are reduced. If the motor coolant is used as the coolant, the result is a simpler and less expensive construction.

The coolant duct can advantageously be integrated into the air intake tube, which as a rule is made of plastic, the transition from the cooling channel into the internal combustion engine being situated in the cylinder head flange of the motor, and the interface being sealed with an additional gasket. Alternatively it is also possible to place a separate coolant line into the flange between the exhaust pipe and the air intake tube, or for the cooling passage also to be placed on a given length into or onto the exhaust pipe. In another embodiment of the invention, the cooling element is a massive heat-conducting part which is a component of the connecting line and is located on the cylinder head in the area of the flange-like connection of the air intake tube. Due to the massive attachment, of the manifold for the recycled exhaust, for example, to the cylinder head, the flowing gases can be cooled simply through the cylinder head flange which has cooling passages anyway.

Advantageously, the elements fastening the intake tube to the cylinder head can be used at least partially as means for fastening the massive part.

It is also advantageously possible to provide a cooling channel carrying coolant in the area of attachment of the massive part in the cylinder head or also at least partially in the massive part, whereby the cooling power can be further optimized.

In another embodiment, the massive heat conducting part is a tubular insert which is integrated internally into the intake tube. This insert is in thermal contact at one end with the cylinder head. With this arrangement, when the intake tube is mounted to the cylinder head a good thermal transfer is easily achieved between the insert, which is preferably made of metal, and the cylinder head. Through this heat transfer the thermal energy delivered by the exhaust gas can be removed into the cooled cylinder head.

This heat transfer can also, if necessary, be increased if the end face of the insert in contact with the cylinder head has an expanded diameter.

The pipe-like connecting duct for the recycled exhaust is brought out through the wall of the intake tube on the side of the insert. The connecting duct and the insert are joined together gas-tight, so that no gaskets are necessary between the connecting duct and the intake tube. The entering exhaust thus strikes against the inside wall of the cooled insert and therefore does not apply any elevated thermal stress to the plastic of the intake tube.

It is especially advantageous if in the area where the connecting duct is brought out there is a gap in the intake tube so as to form a radial space away from the connecting duct and thus to prevent any thermal stress on the intake tube in this area.

These and additional features of preferred embodiments of the invention will be found not only in the claims but also in the description and the drawings, the individual features being applicable individually or severally in the form of subcombinations in the embodiment of the invention and in other fields and may represent advantageous as well as independently patentable embodiments, for which protection is hereby claimed.

THE DRAWINGS

Embodiments of a system of the invention for cooling recycled exhaust gas in an internal combustion engine will be explained with the aid of the drawings, wherein.

Figures 6, 7:
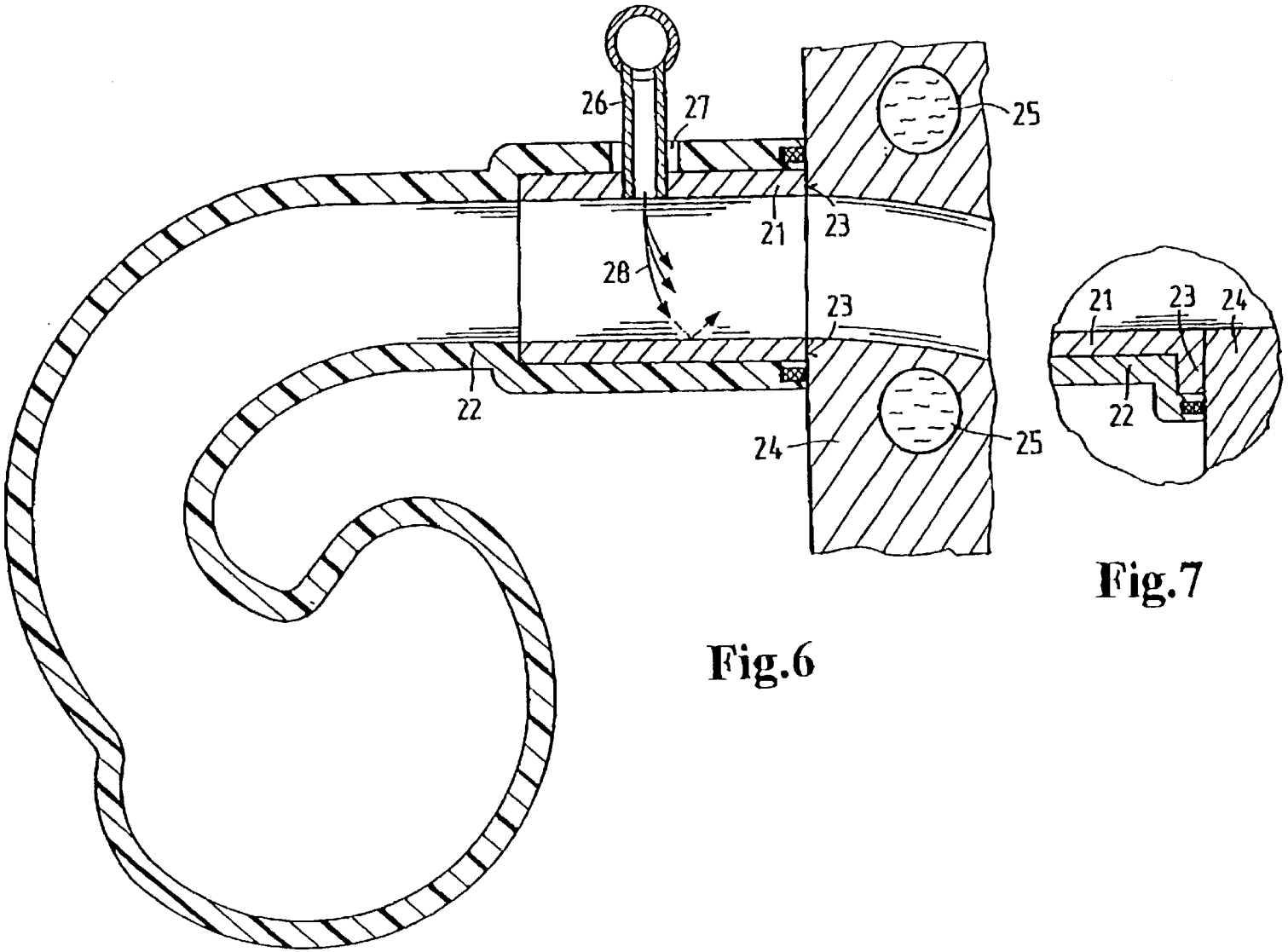
FIG. 6 is a section through an embodiment with a heat-contacted insert.

FIG. 7 a detail of a modified design of the system of FIG. 6.

DESCRIPTION OF THE EMBODIMENTS

Figure 1:
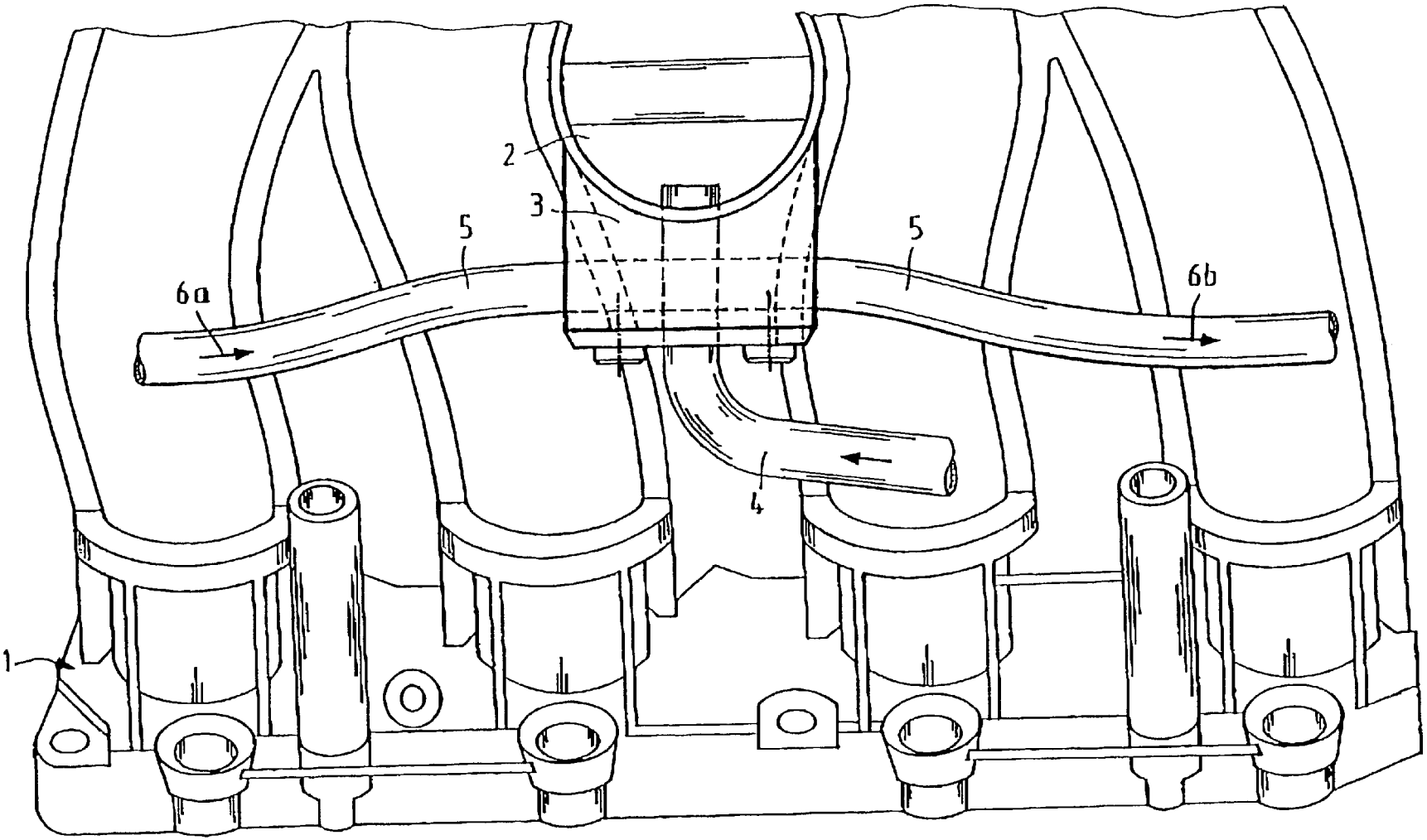
FIG. 1 is a schematic view of a cylinder head of the internal combustion engine with a liquid-cooled connection of the recycled exhaust gas to the intake tube.

In FIG. 1 is shown a cylinder head 1 of an internal combustion engine with the parts which are important here. On an air intake tube 2 through which the air reaches the combustion chambers of the internal combustion engine there is a connection 3 for a manifold 4 through which the exhaust gas tapped from the exhaust pipe is returned to the air intake tube 2. The exhaust gas in the manifold 4 is at a high temperature due to the combustion in the motor, which can damage the intake tube and the adjacent units, since the latter are designed for normal air temperatures and are made mostly of plastic.

Figure 2:
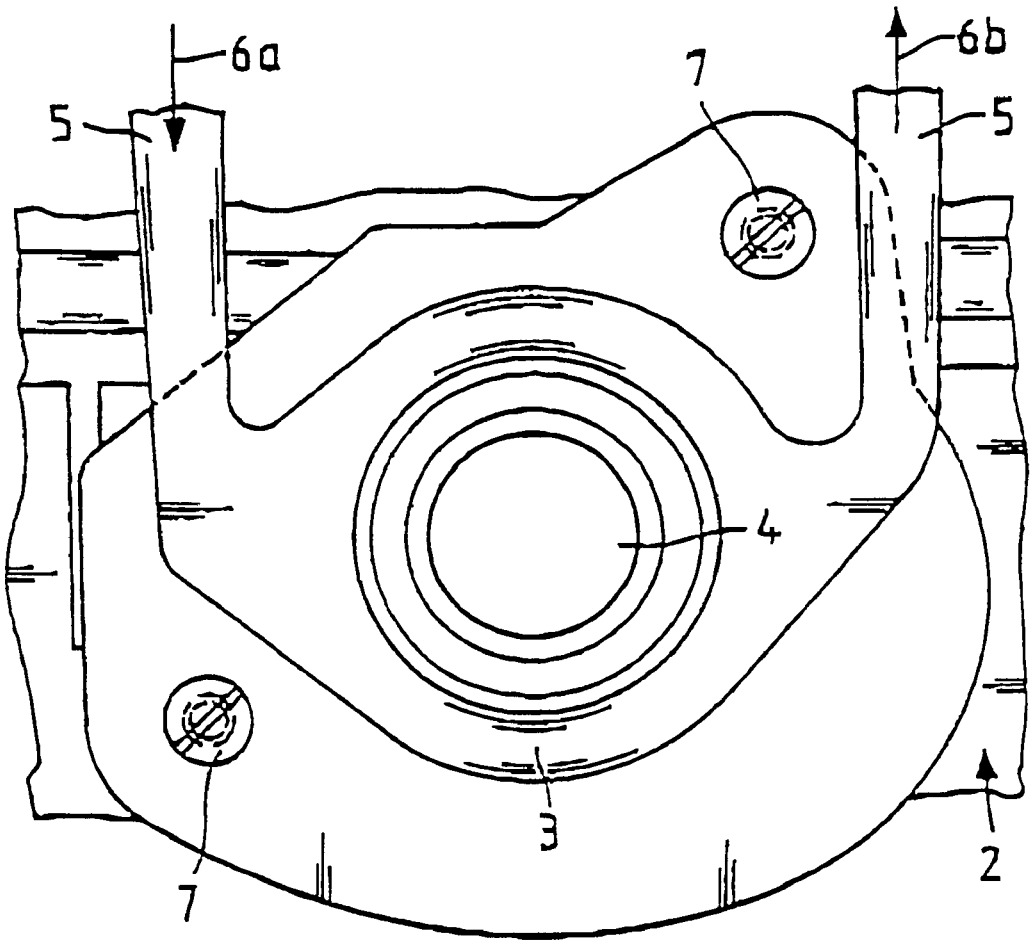
FIG. 2 is a section through the connecting flange for the recycled exhaust gas with a cooling channel.

To the connecting flange 2 for the recycled gas a cooling duct 5 is connected through which the coolant needed by the motor flows according to the arrows 6*a* (in) and 6*b* (out). FIG. 2 shows how this coolant duct passes around the connecting flange 2 and thus around the manifold 4 bearing the recycled exhaust gas as shown in another view. The flange seen in FIG. 2 is fastened to the plastic intake tube 2 with two screws 7. The connecting tube 4 is introduced into the center of this flange.

Figure 3:
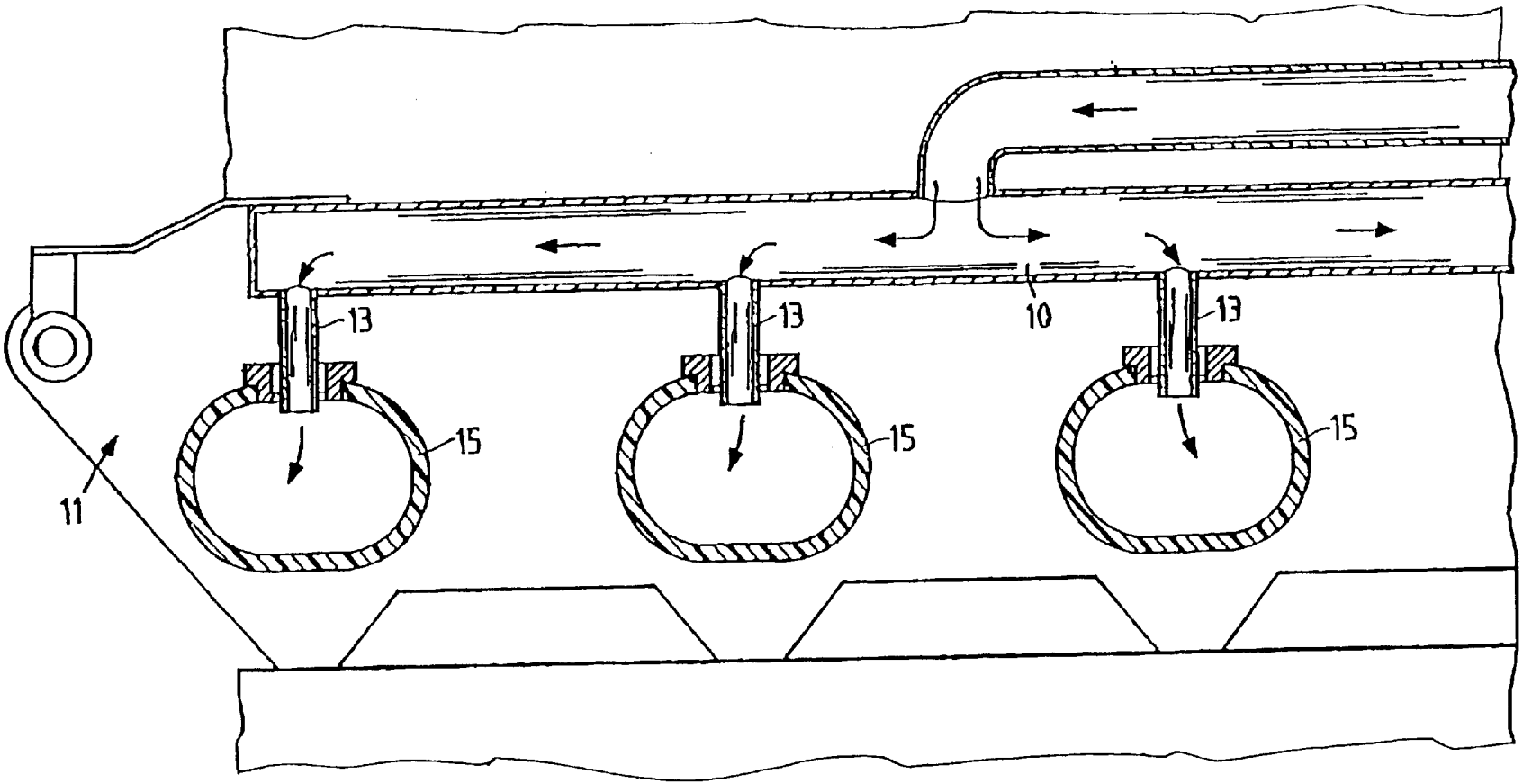
FIG. 3 is a schematic view of a manifold tube for the recycled exhaust gas with a massive connection to the cylinder head.
Figure 4:
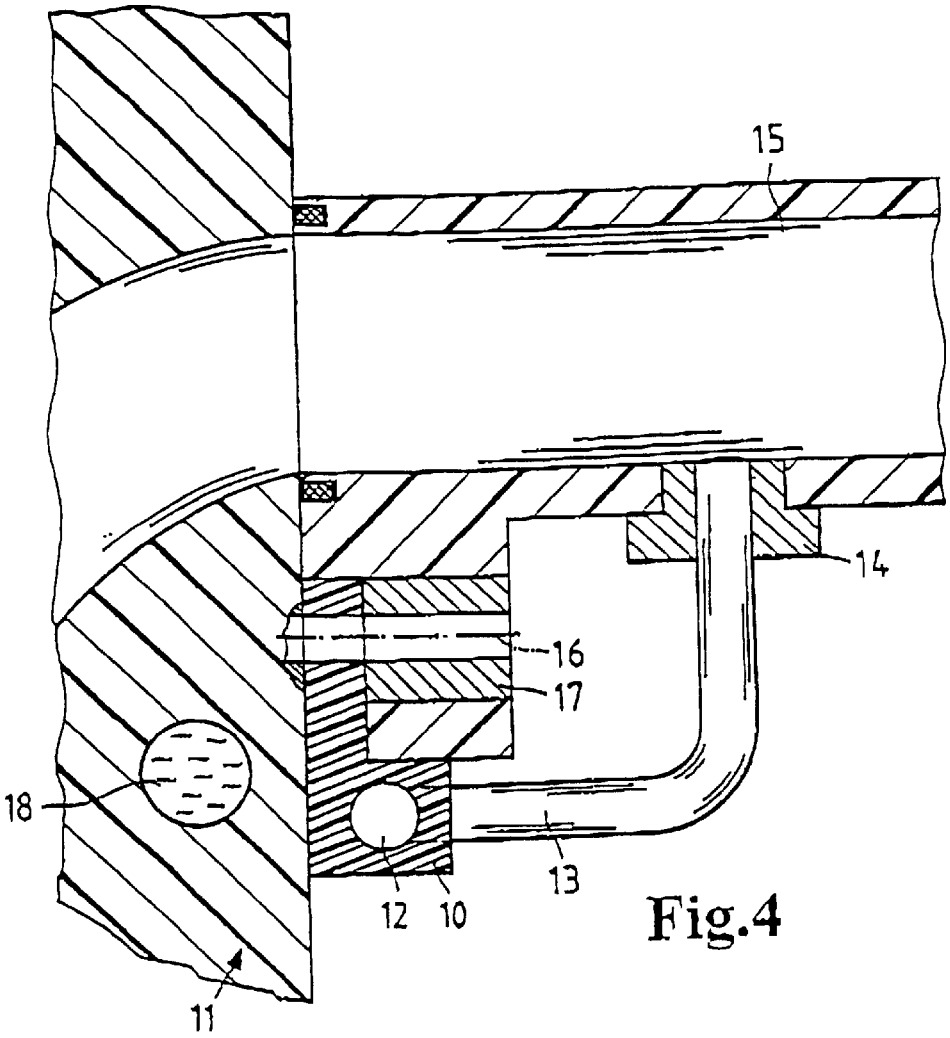
FIG. 4 is a section through the arrangement presented in FIG. 3.

In FIG. 3 an embodiment is to be seen in which a manifold tube 10 for recycled exhaust gas is disposed on a cylinder block 11. In FIG. 4 this arrangement can be seen in section. The recycled exhaust flows through the cross section 12 of the manifold 10 and is passed through pipes 13 and corresponding mounting flanges 14 into an air intake tube 15. To fasten the manifold 10 to the cylinder head, bolt holes 16, preferably already present, can be used for the intake tube, possibly with a metal sleeve 17.

Figure 5:
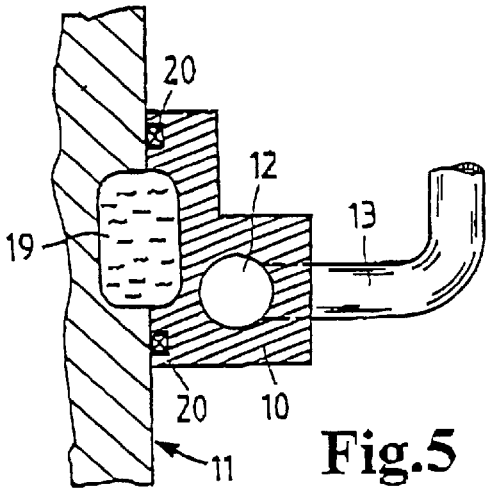
FIG. 5 is a detail of a modified design of the system of FIGS. 3 and 4.

In the cylinder block 11 in FIG. 4 a coolant channel 18 is provided, through which the coolant liquid flows. In an embodiment according to FIG. 5 a coolant channel 19 can also be integrated at least partially into the manifold 10, in which case additional gaskets 20 are necessary.

In FIG. 6 there is shown an embodiment which has a metal insert 21 placed in the plastic intake tube 22 such that one end 23 is in thermal contact with the cylinder head 24. In the cylinder head 24 there is also a coolant channel 25. A connecting tube 26 for the recycled exhaust gas is introduced laterally and affixed in a gas-tight manner. An open space 27 is here provided for the surrounding plastic of the intake tube 22, since the relatively high temperatures of the connecting tube must not harm the plastic of the intake tube 22.

The recycled exhaust gas flows according to arrows 28 into the relatively cool insert 21 and strikes against it such that the thermal stress on the plastic of the intake tube does not become too great. To improve the cooling of the insert 21 still further, according to FIG. 7 the area of the end 23 of the insert is enlarged, so that a still better thermal contact is achieved between the insert 21 and the cylinder head 24.

What is claimed is:

1. System for recirculating exhaust gas in an internal combustion engine, wherein a connecting duct for recirculated exhaust gas is connected to an air intake tube of the engine with at least one interposed cooling element, wherein the cooling element comprises a coolant channel for a cooling liquid, said coolant channel being integrated into a flange which connects the connecting duct to the air intake tube, and the coolant channel also is integrated into the air intake tube, which is made of plastic, the transition of the coolant channel into the internal combustion engine being arranged in a cylinder head flange of the engine and being sealed with an additional gasket.

2. System according to claim 1, wherein coolant liquid for cooling the engine is used as the cooling liquid.

3. System according to claim 1, further comprising a separate cooling line disposed in the flange between the connecting duct for exhaust gas and the air intake tube.

4. System for recirculating exhaust gas in an internal combustion engine wherein a connecting line for recirculated exhaust gas is connected to an air intake tube with at least one interposed cooling element, said at least one cooling element comprising a massive, heat-conducting part which is at least partially a component of the connecting line and is disposed next to a cylinder head of the engine adjacent the connection of the connecting line to the air intake tube, wherein the massive heat-conducting part is a tubular insert in the air intake tube which is placed with one end against the cylinder head with thermal contact, and the connecting line extends through the wall of the air intake tube laterally of the insert.

5. System according to claim 4, a free gap is provided where the connecting line extends through the air intake tube in order to radially space the air intake tube away from the connecting line.

6. System according to claim 4, wherein the end of the insert in contact with the cylinder head has an enlarged surface due to expansion of the outside diameter.

* * * * *